US007976330B2

(12) United States Patent
Lin

(10) Patent No.: US 7,976,330 B2
(45) Date of Patent: Jul. 12, 2011

(54) SECURELY LATCHED POWER CONNECTOR ASSEMBLY

(75) Inventor: Chih-Hsin Lin, Hsien Shi Town (TW)

(73) Assignee: K.S. Terminals Inc., Chang Hwa (TW)

( * ) Notice: Subject to any disclaimer, the term of this patent is extended or adjusted under 35 U.S.C. 154(b) by 0 days.

(21) Appl. No.: 12/549,631

(22) Filed: Aug. 28, 2009

(65) Prior Publication Data

US 2011/0053406 A1 Mar. 3, 2011

(51) Int. Cl.
*H01R 4/26* (2006.01)

(52) U.S. Cl. ..... 439/353; 439/441; 439/732

(58) Field of Classification Search ..... 439/441, 439/754, 353, 295, 732
See application file for complete search history.

(56) References Cited

U.S. PATENT DOCUMENTS

| | | | | | |
|---|---|---|---|---|---|
| 2,411,861 | A | * | 12/1946 | Antony, Jr et al. | 439/740 |
| 2,838,739 | A | * | 6/1958 | Winkler | 439/295 |
| 3,824,524 | A | * | 7/1974 | Glover | 439/282 |
| 3,979,615 | A | * | 9/1976 | Neff | 310/71 |
| 4,019,167 | A | * | 4/1977 | Barker | 336/96 |
| 4,310,211 | A | * | 1/1982 | Bunnell et al. | 439/358 |
| 4,403,824 | A | * | 9/1983 | Scott | 439/680 |
| 4,455,056 | A | * | 6/1984 | Herrmann et al. | 439/347 |
| 4,527,849 | A | * | 7/1985 | Marach | 439/591 |
| 4,701,000 | A | * | 10/1987 | Suprono | 439/423 |
| 4,810,207 | A | * | 3/1989 | Butterfield | 439/529 |
| 5,131,858 | A | * | 7/1992 | Heimbrock | 439/181 |
| 5,147,228 | A | * | 9/1992 | Miller et al. | 439/741 |
| 5,176,528 | A | * | 1/1993 | Fry et al. | 439/181 |
| 5,342,221 | A | * | 8/1994 | Peterson | 439/677 |
| 5,674,094 | A | * | 10/1997 | Hutchinson et al. | 439/680 |
| 5,906,511 | A | * | 5/1999 | Bozzer et al. | 439/579 |
| 6,022,246 | A | * | 2/2000 | Ko | 439/680 |
| 6,116,938 | A | * | 9/2000 | Myer et al. | 439/353 |
| 6,135,822 | A | * | 10/2000 | Hwang | 439/680 |
| 6,183,287 | B1 | * | 2/2001 | Po | 439/358 |
| 6,332,783 | B1 | * | 12/2001 | Ukiya et al. | 439/76.1 |
| 6,364,718 | B1 | * | 4/2002 | Polgar et al. | 439/680 |
| 6,860,765 | B1 | * | 3/2005 | Spink, Jr. | 439/680 |
| 7,195,518 | B2 | * | 3/2007 | Bert et al. | 439/607.43 |
| 7,470,143 | B2 | * | 12/2008 | Osborn et al. | 439/441 |
| 7,618,279 | B1 | * | 11/2009 | Osborn et al. | 439/441 |

* cited by examiner

*Primary Examiner* — Neil Abrams
(74) *Attorney, Agent, or Firm* — Ming Chow; Sinorica, LLC

(57) ABSTRACT

A securely latched power connector assembly includes a male connector and a female connector connected with a first leading wire and a second leading wire, respectively. A first conductive terminal of the male connector has a first buckle portion for retaining a core of the first leading wire. A second conductive terminal of the female connector has a second buckle portion for retaining a core of the second leading wire. When the connectors are combined, a hollow plug of the male connector is inserted into a hollow socket of the female connector, and the first coupling structures of the male connector and the second coupling structures of the female connector are firmly coupled, while the second pin of the second conductive terminal being inserted into the hollow plug to contact with the first pin of the first conductive terminal, thereby achieving electrical connection.

16 Claims, 12 Drawing Sheets

SECURELY LATCHED POWER CONNECTOR ASSEMBLY

BACKGROUND OF THE INVENTION

1. Technical Field

The present invention relates to electrical connectors and more particularly, to a securely latched power connector assembly that is especially suitable for high power connection.

2. Description of Related Art

Connector assemblies have nowadays been widely used in various industries and diverse mechanical and electrical devices for allowing rapid transmission of data, signals and electrical power as desired. Introduction of such connector assemblies not only has brought information transmission to an unprecedented level, but also has made people experience enhanced convenience in daily life.

As mentioned above, connector assemblies can be used in a broad range of applications. Thus, for different applications, connector assemblies may be significantly distinguishing in their design concepts and function emphases. As to a power connector assembly designed for transmission of electricity, it is important to ensure firm and stable combination between the casings of its male and female connectors, reliable connection between the conductive terminals of its male and female connectors, and sound installation of the input and output leading wires in each of its male and female connectors, without the risk of temporarily, or even permanently, loosing under consecutive or intermittent exotic vibration. This would be an invariable challenge to research and development of power connector assemblies.

SUMMARY OF THE INVENTION

With the attempt to answer to the foregoing challenge, the present invention provides a securely latched power connector assembly that primarily includes a male connector and a female connector. The male connector and the female connector are connected with at lease one first leading wire and at lease one second leading wire, respectively. Each of the first leading wire and the second leading wire has a core and an insulating jacket. The male connector includes a first insulating casing, a second insulating casing, and at least one first conductive terminal. The first insulating casing has a first opening formed at a rear end thereof for allowing the core of the first leading wire to be inserted thereinto. The first insulating casing also has a second opening formed at a front end thereof and intercommunicating with the first opening. Each said first conductive terminal is accommodated in the second opening. The first conductive terminal has a first bottom plate that is bent upward near the first opening to form a first inclined portion. The first inclined portion has a first through hole for allowing the core of the first leading wire to pierce therethrough. The first inclined portion is bent downward at an upper end thereof to form a first buckle portion for retaining the core of the first leading wire. The first bottom plate has an end distant from the first through hole extending outward to form a first pin. The second insulating casing has a third opening formed at a rear end thereof for allowing the front end of the first insulating casing to be inserted thereinto. The second insulating casing has a front end extending outward to form a hollow plug for accommodating the first pin of the first conductive terminal therein. The second insulating casing has its upper and lower surfaces each formed with a first coupling structure. The female connector includes a third insulating casing, a fourth insulating casing, and a second conductive terminal. The third insulating casing has a fourth opening formed at a front end thereof for allowing the core of the second leading wire to be inserted thereinto. The third insulating casing has a fifth opening formed at a rear end thereof and intercommunicating with the fourth opening. The second conductive terminal is accommodated in the fifth opening. The second conductive terminal has a second bottom plate that is bent upward near the fourth opening to form a second inclined portion. The second inclined portion has a second through hole for allowing the core of the second leading wire to pierce therethrough. The second inclined portion is bent downward at an upper end thereof to form a second buckle portion for retaining the core of the second leading wire. The second bottom plate has an end distant from the second through hole extending outward to form a second pin. The fourth insulating casing has a sixth opening formed at a front end thereof for allowing the rear end of the third insulating casing to be inserted thereinto. The fourth insulating casing has a rear end extending outward to form at least one hollow socket for accommodating the second pin of the second conductive terminal therein. The fourth insulating casing has its upper and lower surfaces each formed with a second coupling structure for fittingly coupled with one corresponding said first coupling structure of the male connector. Thereby, when the male connector and the female connector are combined, the hollow plug of the male connector is accommodated in the hollow socket of the female connector, and the first coupling structures of the male connector and the second coupling structures of the female connector are firmly coupled, while the second pin of the second conductive terminal is inserted into the hollow plug and gets contacted with the first pin of the first conductive terminal, thereby achieving electrical connection.

Hence, one objective of the present invention is to provide the aforementioned securely latched power connector assembly, wherein the male connector has the hollow plug inserted into the hollow socket of the female connector, thus achieving improved combination between the male and female connectors.

Another objective of the present invention is to provide the aforementioned securely latched power connector assembly, wherein the male connector has the first coupling structures coupled with the second coupling structures of the female connector, thus achieving improved combination between the male and female connectors.

Still another objective of the present invention is to provide the aforementioned securely latched power connector assembly, wherein the male connector utilizes the first buckle portion provided on the first conductive terminal to retain the core of the first leading wire, thus providing an improved wire coupling effect.

Yet another objective of the present invention is to provide the aforementioned securely latched power connector assembly, wherein the female connector utilizes the second buckle portion provided on the second conductive terminal to retain the core of the second leading wire, thus providing an improved wire coupling effect.

BRIEF DESCRIPTION OF THE DRAWINGS

The invention as well as a preferred mode of use, further objectives and advantages thereof will be best understood by reference to the following detailed description of illustrative embodiments when read in conjunction with the accompanying drawings, wherein.

DETAILED DESCRIPTION OF THE PREFERRED EMBODIMENTS

While the present invention provides a securely latched power connector assembly, the principle of electrical conduction and the principle of waterproof structure used therein have been appreciated by people of ordinary skill in the art, and need not to be described in any length herewith. Meantime, since the accompanying drawings provided herewith are intended to illustrate the structural characteristics related to the present invention, they need not to be, and are not, drawn in scale.

Figure 1:
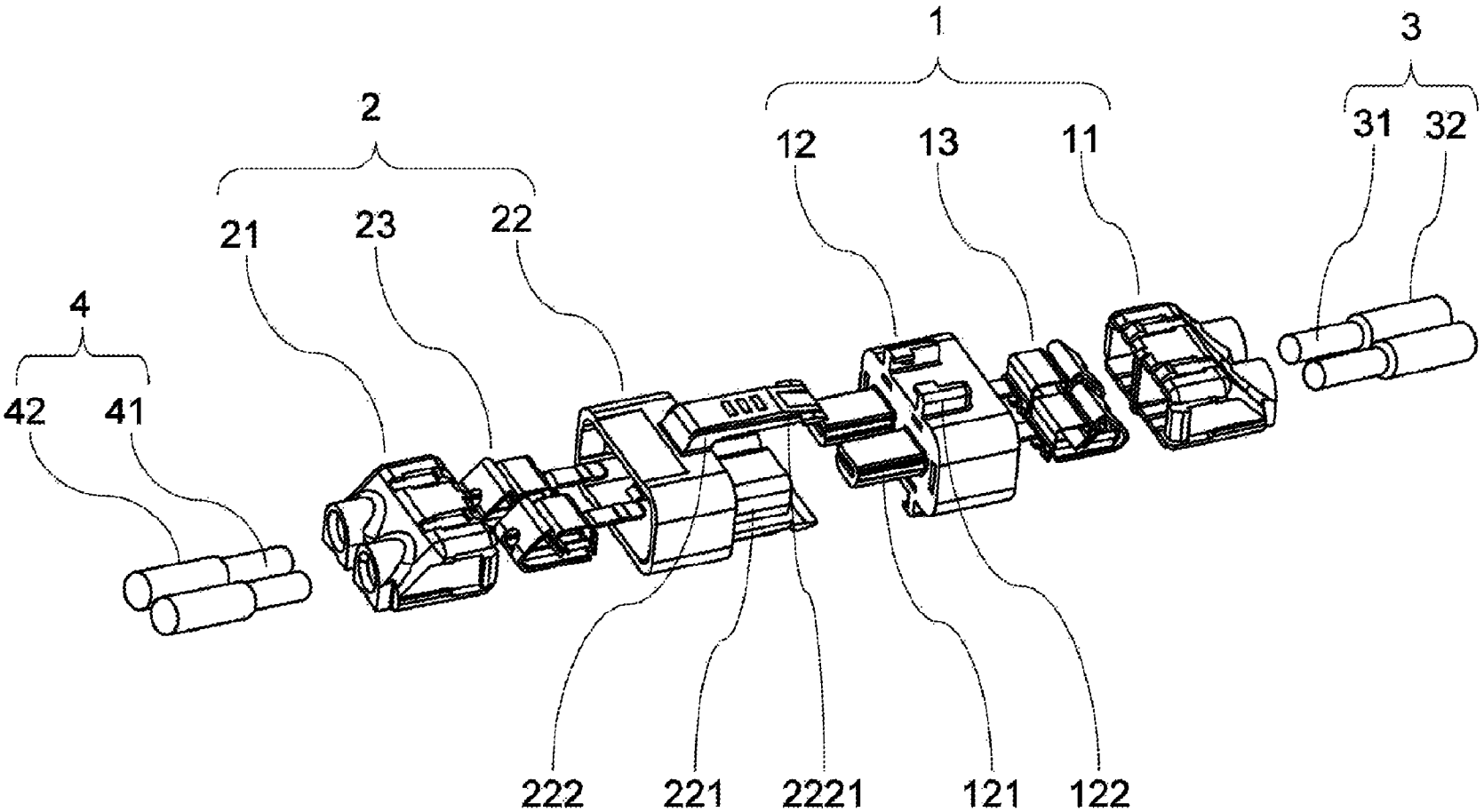
FIG. 1 is an exploded view of a securely latched power connector assembly according to a first preferred embodiment of the present invention.

First, please refer to FIG. 1 for an exploded view of a securely latched power connector assembly according to a first preferred embodiment of the present invention. The power connector assembly primarily comprises a male connector 1 and a female connector 2, each having a first leading wire 3 or a second leading wire 4. Each of the first and second leading wires 3, 4 has a core 31 or 41, and an insulating jacket 32 or 42. The male connector 1 includes a first insulating casing 11, a second insulating casing 12, and a first conductive terminal 13. The female connector 2 includes a third insulating casing 21, a fourth insulating casing 22, and a second conductive terminal 23.

Figure 2A:
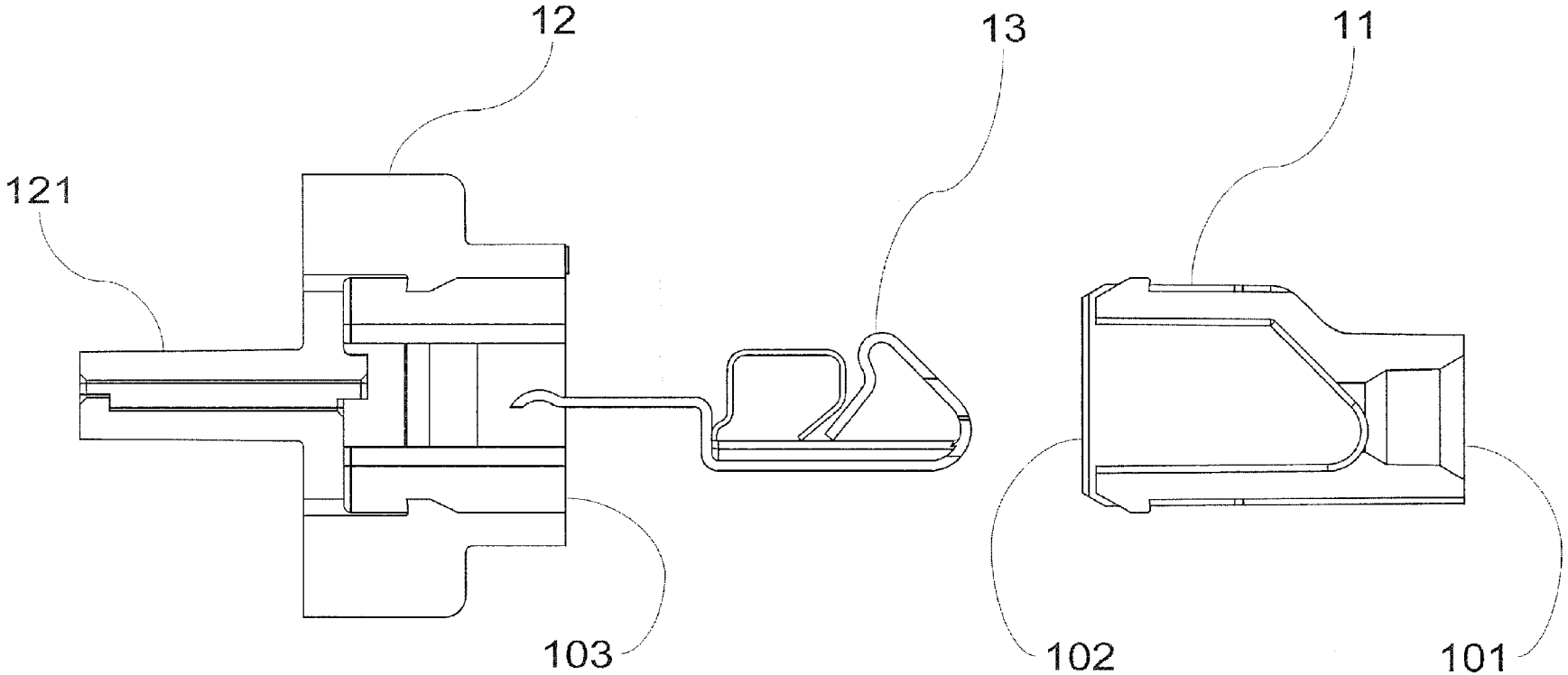
FIG. 2A is a lateral sectional view of a male connector in a securely latched power connector assembly according to the first preferred embodiment of the present invention.

Referring to FIG. 1 in conjunction with FIG. 2A, the first insulating casing 11 has a first opening 101 formed at a rear end thereof for allowing the core 31 of the first leading wire 3 to be inserted thereinto. The first insulating casing 11 also has a second opening 102 formed at a front end thereof and intercommunicating with the first opening 101. The second insulating casing 12 has a third opening 103 formed at a rear end thereof for allowing the front end of the first insulating casing 11 to be inserted thereinto. The second insulating casing 12 has a front end extending outward as a hollow plug 121.

Figure 2B:
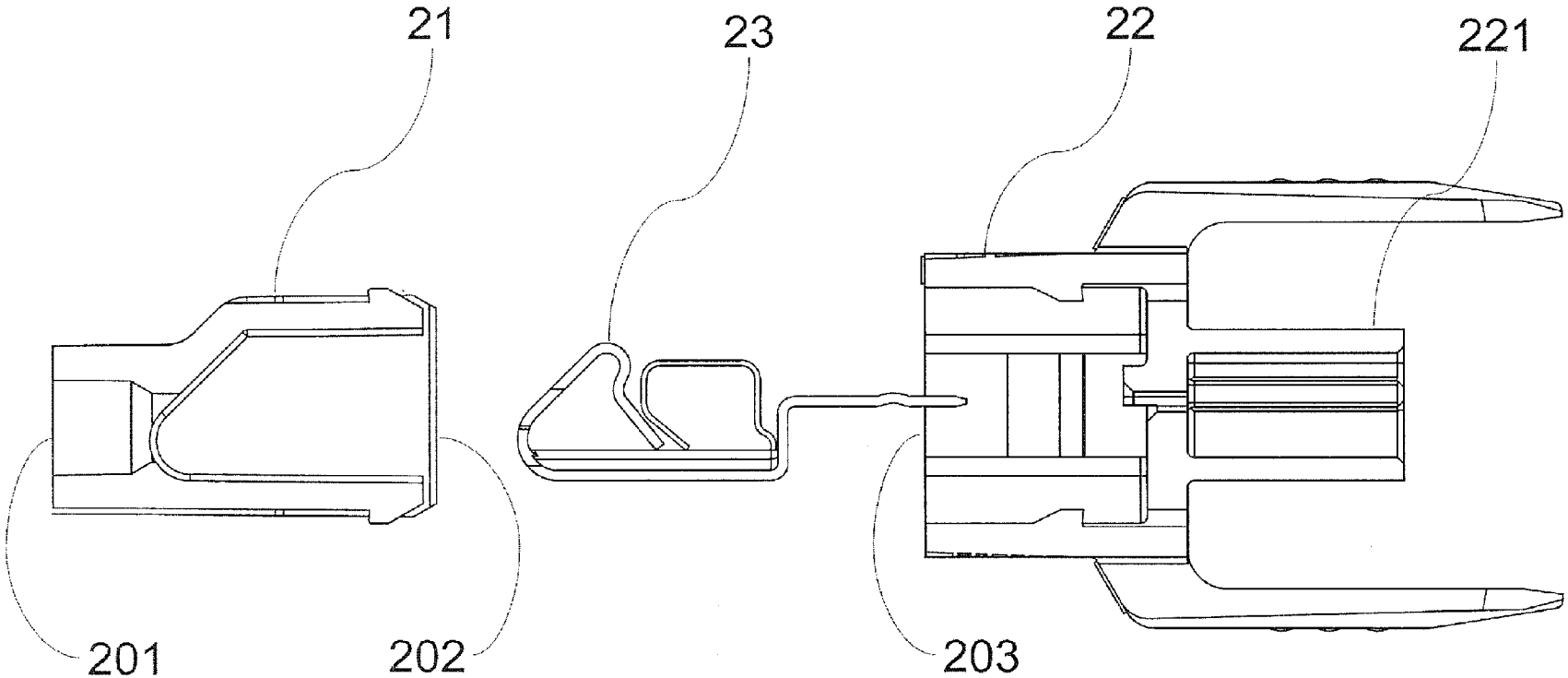
FIG. 2B is a lateral sectional view of a female connector according to the first preferred embodiment of the present invention.

Referring to FIG. 1 in conjunction with FIG. 2B, the third insulating casing 21 has a fourth opening 201 formed at a front end thereof for allowing the core 41 of the second leading wire 4 to be inserted thereinto. The third insulating casing 21 also has a fifth opening 202 formed at a rear end thereof and intercommunicating with the fourth opening 201. The fourth insulating casing 22 has a sixth opening 203 formed at a front end thereof for allowing the rear end of the third insulating casing 21 to be inserted thereinto. The fourth insulating casing 22 has a rear end extending outward as a hollow socket 221.

Figure 3A:
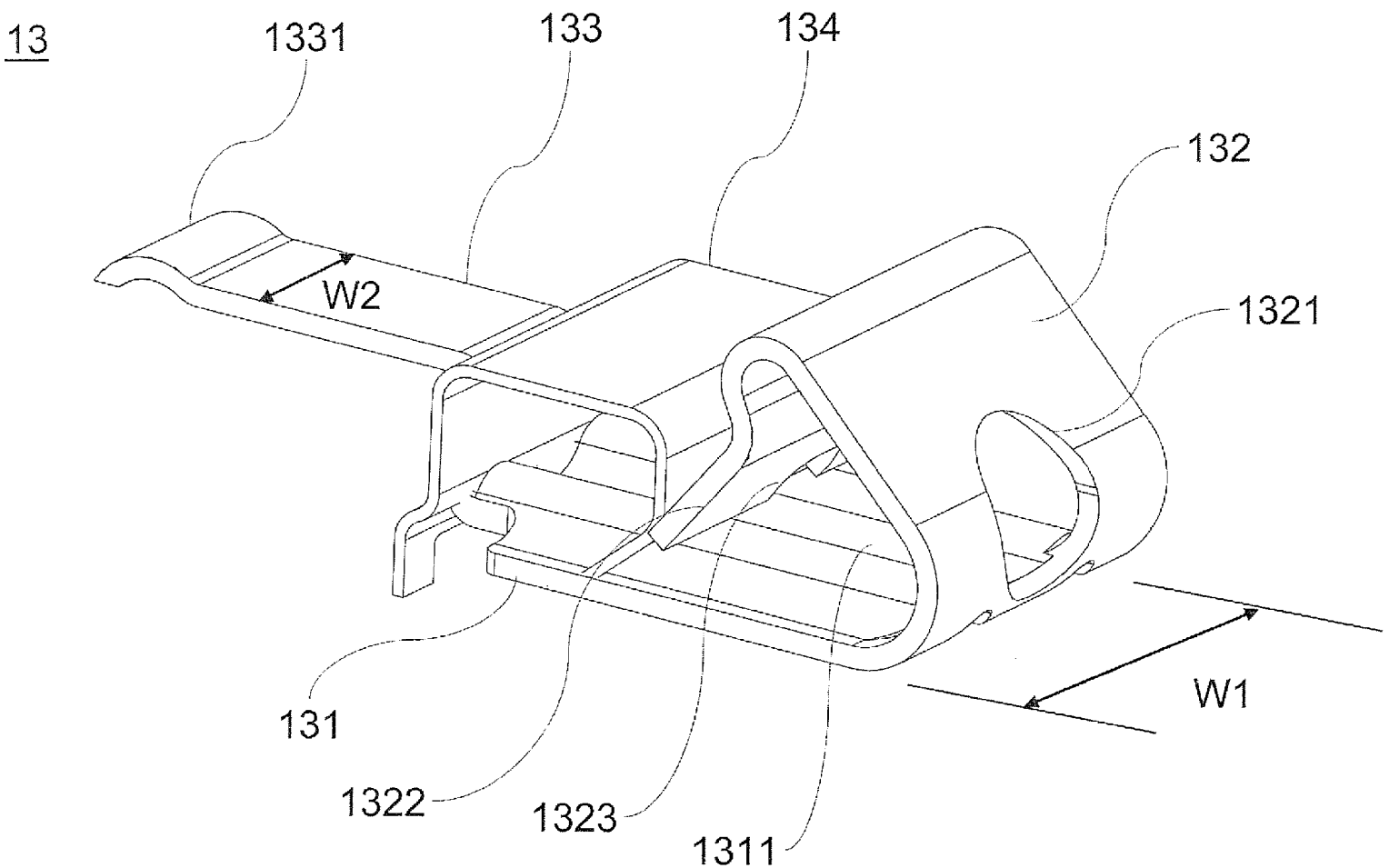
FIG. 3A is a schematic drawing of a first conductive terminal according to the first preferred embodiment of the present invention.

As shown in FIGS. 2A and 3A, the first conductive terminal 13 can be accommodated in the second opening 102. The first conductive terminal 13 has a first bottom plate 131 formed with a first groove 1311 for accommodating the core 31 of the first leading wire 3. The first bottom plate 131 is bent upward near the first opening 101 to form a first inclined portion 132. The first inclined portion 132 has a first through hole 1321 for allowing the core 31 of the first leading wire 3 to pierce therethrough. The first inclined portion 132 is bent downward at an upper end thereof to form a first buckle portion 1322. The first buckle portion 1322 may be further provided with a first notch 1323 for facilitating holding the core 31 of the first leading wire 3 with improved firmness. In addition, the first bottom plate 131 has an end distant from the first through hole 1321 extending outward to form a first pin 133, which is to be inserted into the hollow plug 121 of the second insulating casing 12. The first pin 133 may be bent to form a first claw 1331. Therein, the first pin 133 has a width W2 smaller than a width W1 of the first bottom plate 131. Moreover, the male connector 1 further includes a first resilient plate 134 located between the second insulating casing 12 and the first inclined portion 132 of the first conductive terminal 13, for helping the first buckle portion 1322 to hold the core 31 of the first leading wire 3 with improved firmness.

Figure 3B:
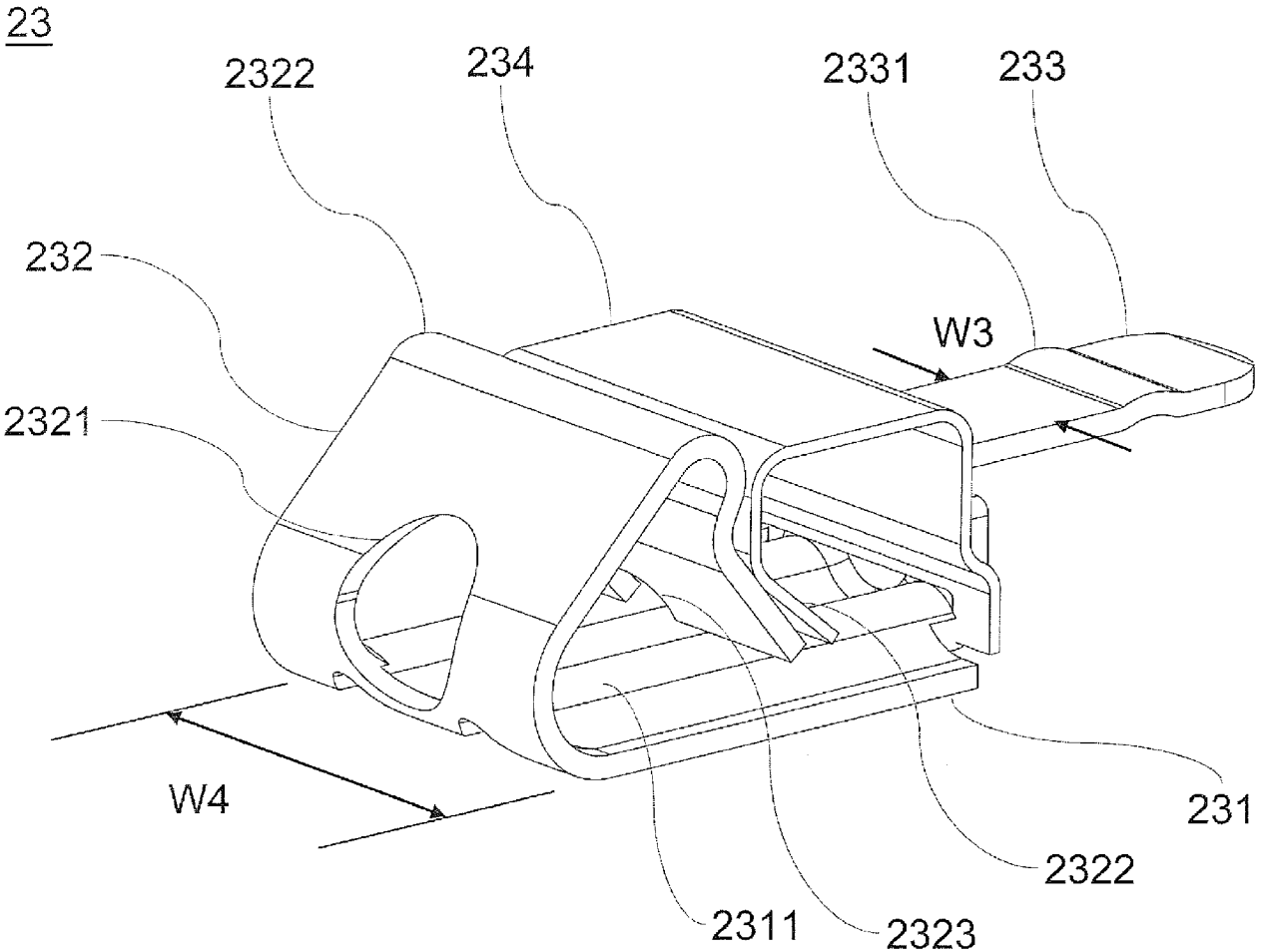
FIG. 3B is a schematic drawing of a second conductive terminal according to the first preferred embodiment of the present invention.

As shown in FIGS. 2B and 3B, the second conductive terminal 23 can be accommodated in the fifth opening 202. The second conductive terminal 23 has a second bottom plate 231 formed with a second groove 2311 for accommodating the core 41 of the second leading wire 4. In the second conductive terminal 23, the second bottom plate 231 is bent upward near the fourth opening 201 to form a second inclined portion 232. The second inclined portion 232 has a second through hole 2321 for allowing the core 41 of the second leading wire 4 to pierce therethrough. Meantime, the second inclined portion 232 is bent downward at an upper end thereof to form a second buckle portion 2322. The second buckle portion 2322 may be further provided with a second notch 2323 for facilitating holding the core 41 of the second leading wire 4 with improved firmness. The second bottom plate 231 has an end distant from the second through hole 2321 extending outward to form a second pin 233, which is to be inserted into the hollow socket 221 of the fourth insulating casing 22. The second pin 233 may be further bent to form a second claw 2331. Therein, the second pin 233 has a width W4 smaller than a width W3 of the second bottom plate 231. Moreover, the female connector 2 further includes at least one second resilient plate 234 located between the fourth insulating casing 22 and the second inclined portion 232 of the second conductive terminal 23, for helping the second buckle portion 2322 to hold the core 41 of the second leading wire 4 with improved firmness.

Figure 3C:
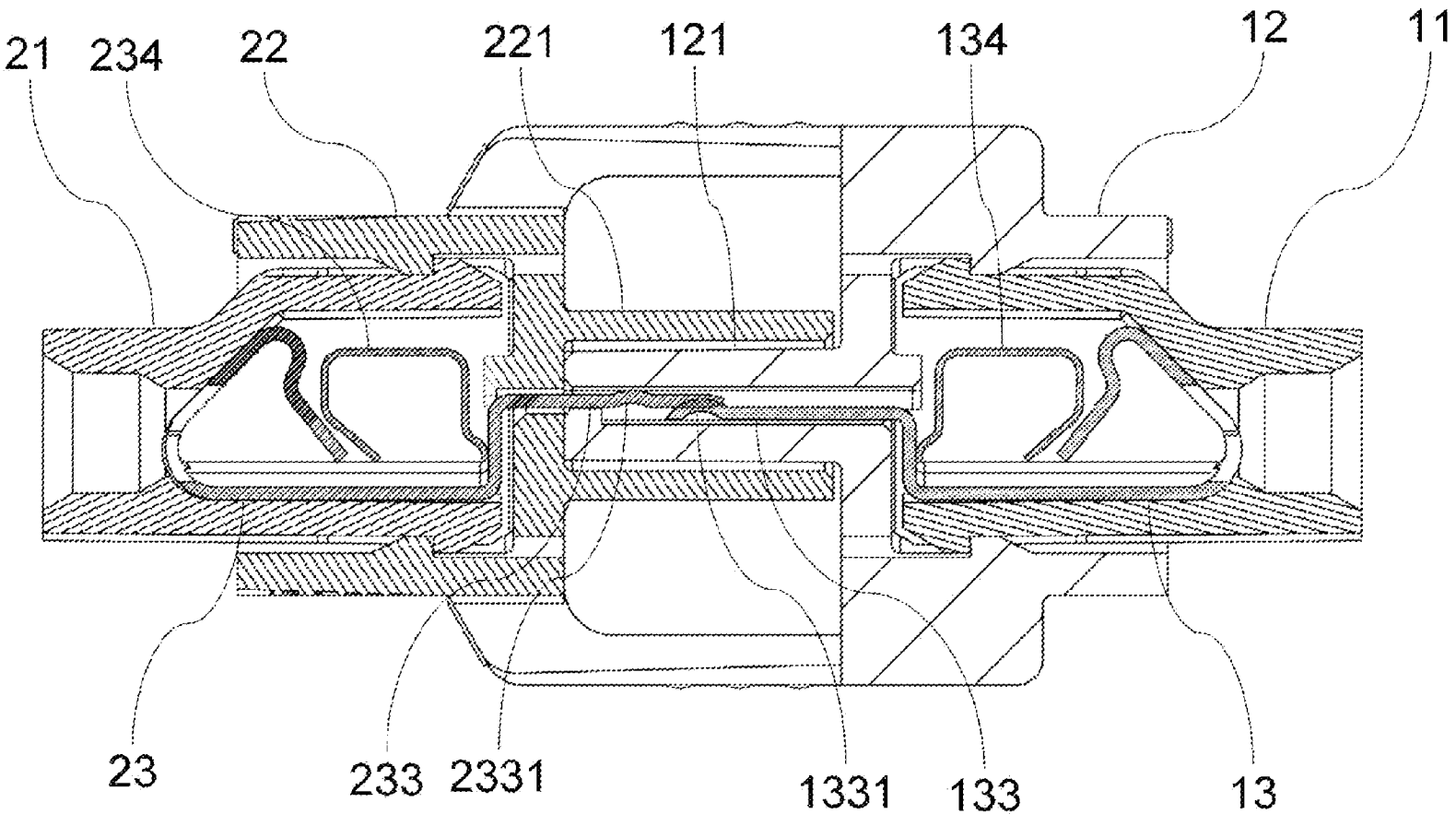
FIG. 3C is a lateral sectional view of the male and female connectors latched with each other according to the first preferred embodiment of the present invention.

Please refer to FIG. 3C. The second claw 2331 contacts with the first pin 133 of the first conductive terminal 13, thereby achieving electrical connection therebetween. Further, the second claw 2331 contacts with the first claw 1331 of the first pin 133, thereby achieving better electrical connection.

Figure 4A:
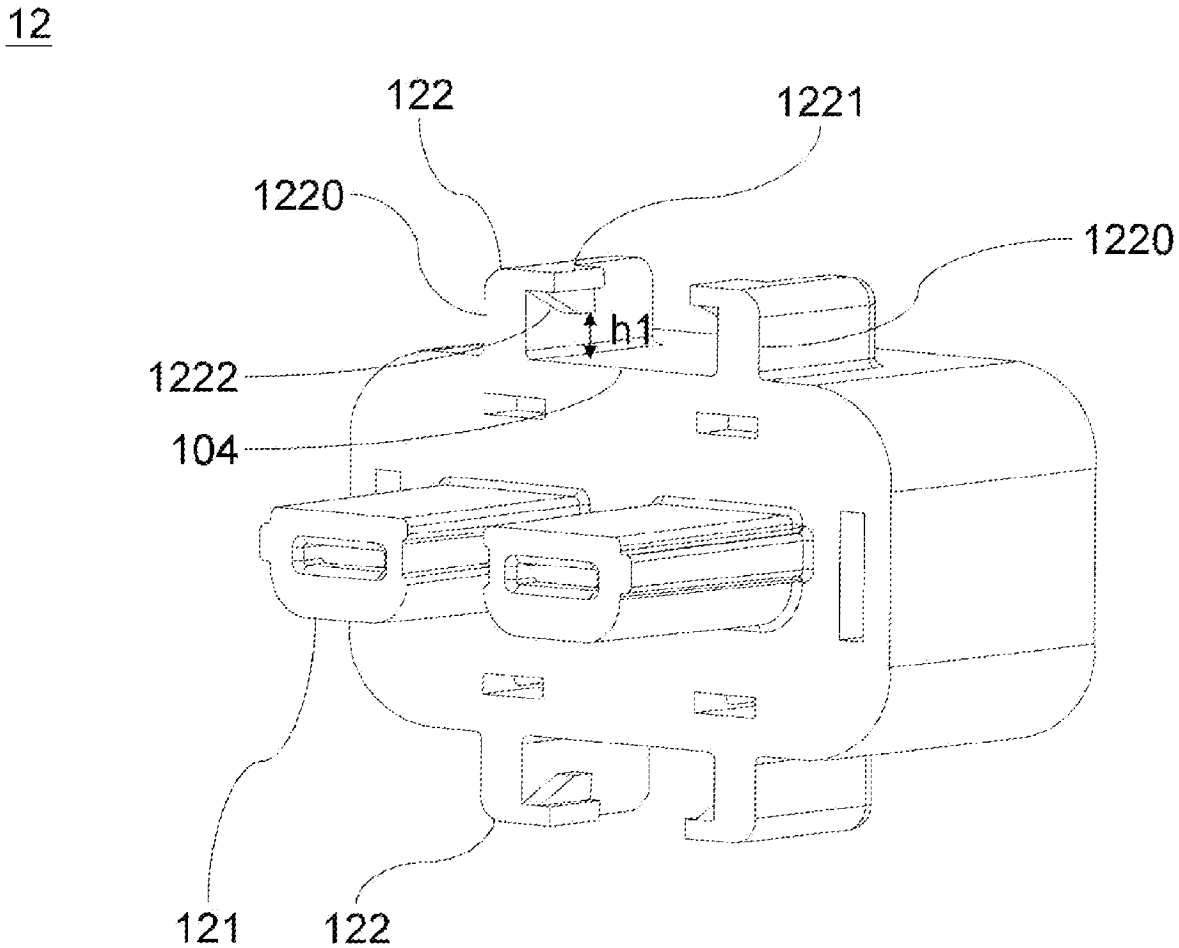
FIG. 4A is a schematic drawing of a second insulating casing according to the first preferred embodiment of the present invention.

Referring to FIG. 4A, in the present embodiment, the second insulating casing 12 has its upper and lower surfaces each formed with a first coupling structure 122. The first coupling structure 122 includes a pair of facing walls 1220. Each said wall 1220 has a first flange 1221 extending toward the other said wall 1220. The first flange 1221 and the second insulating casing 12 jointly define a seventh opening 104. In addition, a first wedge 1222 is provided between each said flange 1221 and the second insulating casing 12 facing the seventh opening 104 so as to give the seventh opening 104 a tapered shape. Therein, the seventh opening 104 has a minimum opening height h1.

Figure 4B:
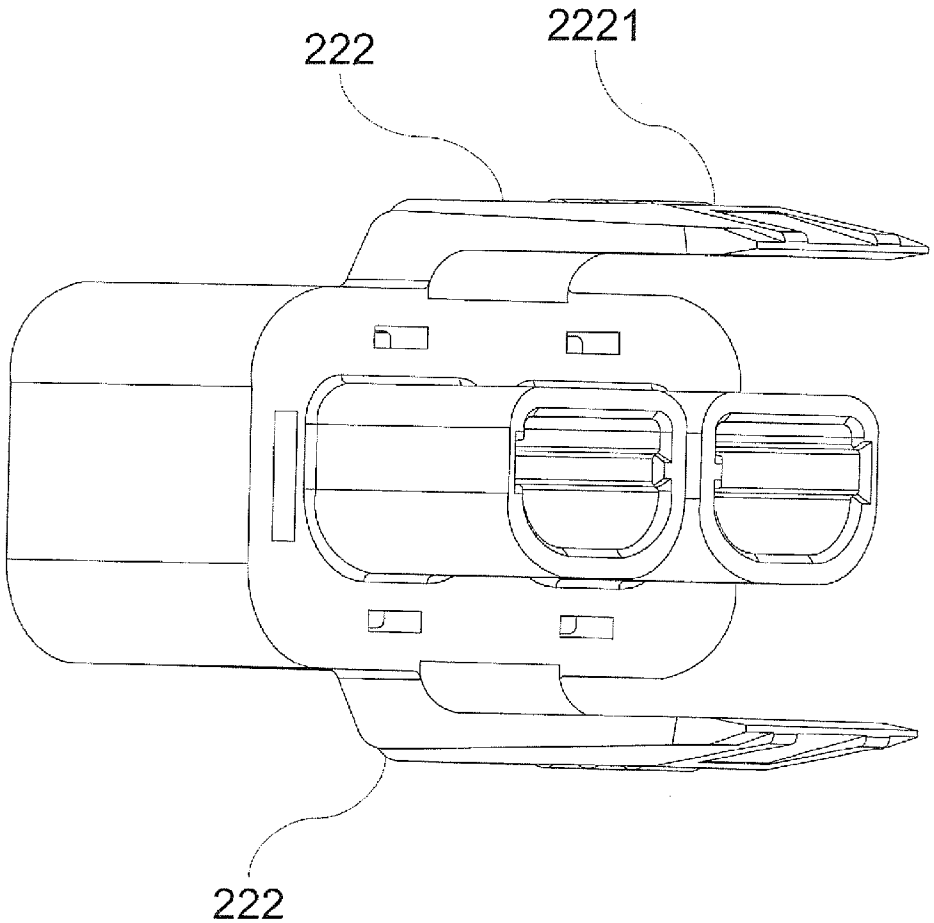
FIG. 4B is a schematic drawing of a fourth insulating casing according to the first preferred embodiment of the present invention.
Figure 4C:
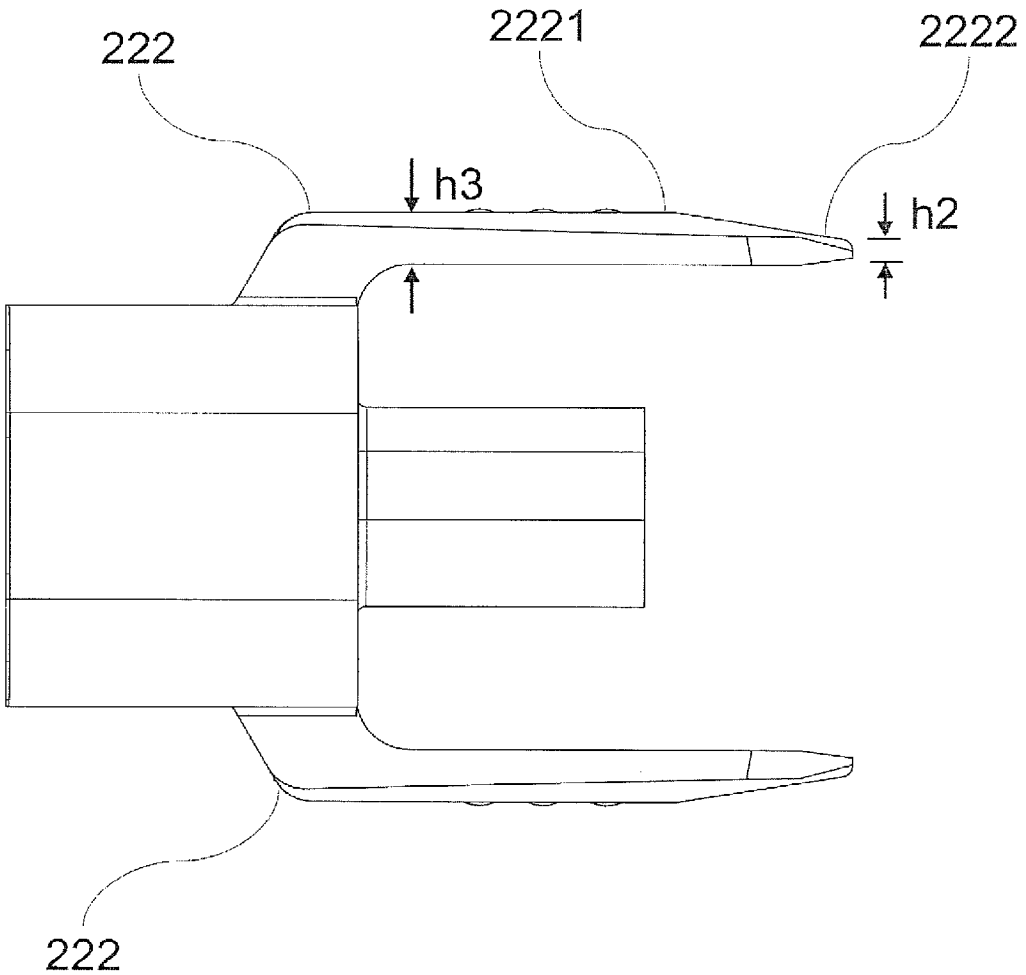
FIG. 4C is a lateral sectional view the fourth insulating casing according to the first preferred embodiment of the present invention.

Please refer to FIGS. 4B and 4C. The fourth insulating casing 22 has its upper and lower surfaces each formed with a second coupling structure 222 for fittingly coupled with a corresponding said first coupling structure 122 of the male connector 1. Therein, each said second coupling structure 222 is a flat arm 2221 to be inserted into a corresponding said seventh opening 104 of the first coupling structure 122. The flat arm 2221 has a front end formed with a second wedge 2222 so that the flat arm 2221 has a thickness h3 gradually reduced from its rear end to its front end and becoming h2 at the front end. Therefore, upon combination of the male connector 1 and the female connector 2, the hollow plug 121 of the male connector 1 is accommodated in the hollow socket 221 of the female connector 2. At this time, the first coupling structures 122 of the male connector 1 and the second coupling structures 222 of the female connector 2 are coupled mutually. By the joint guidance of the first wedges 1222 and the second wedges 2222, the seventh opening 104 of the first coupling structure 122 performs elastic deformation, so as to allow the flat arms 2221 of the second coupling structure 222 to be inserted therein. After the insertion of the flat arms 2221, since the minimum height h1 of the seventh openings 104 is smaller than the thickness h2 of the front ends of the flat arms 2221, the flat arms 2221 of the second coupling structures 222 are retained from leaving the seventh openings 104, thereby ensuring the firmer combination between the male connector 1 and the female connector 2.

Figure 5A:
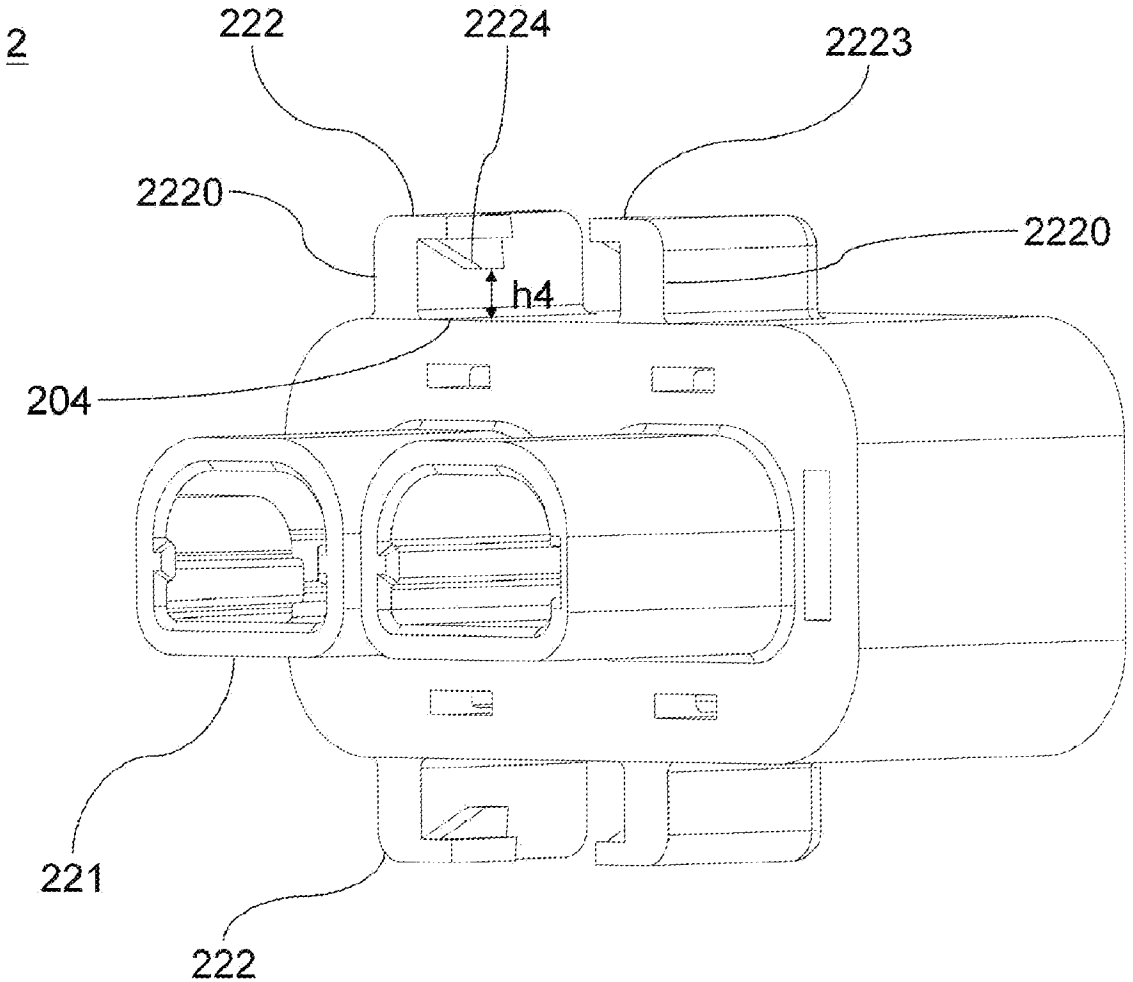
FIG. 5A is a schematic drawing of a second insulating casing according to a second preferred embodiment of the present invention.
Figure 5B:
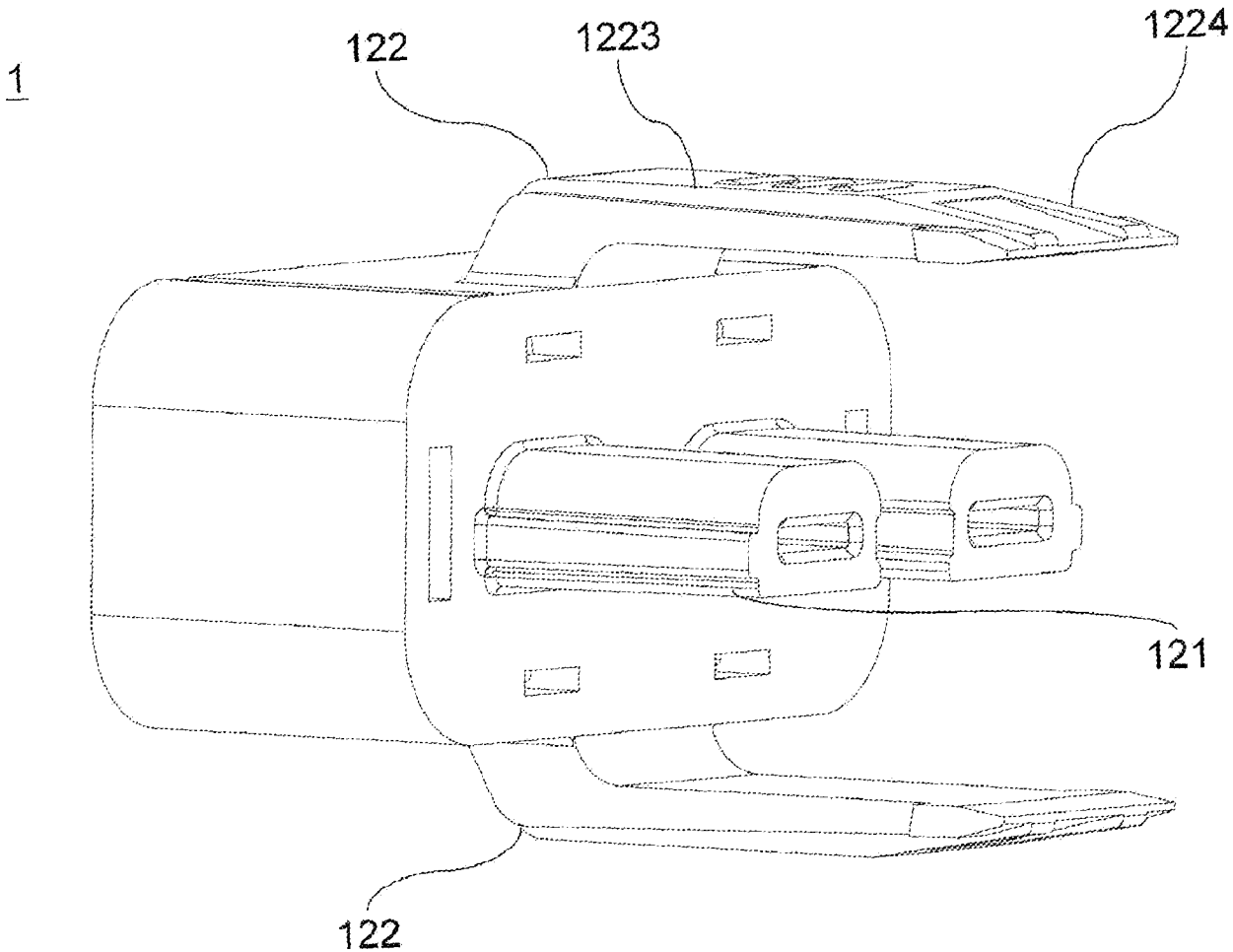
FIG. 5B is a schematic drawing of a fourth insulating casing according to the second preferred embodiment of the present invention.
Figure 5C:
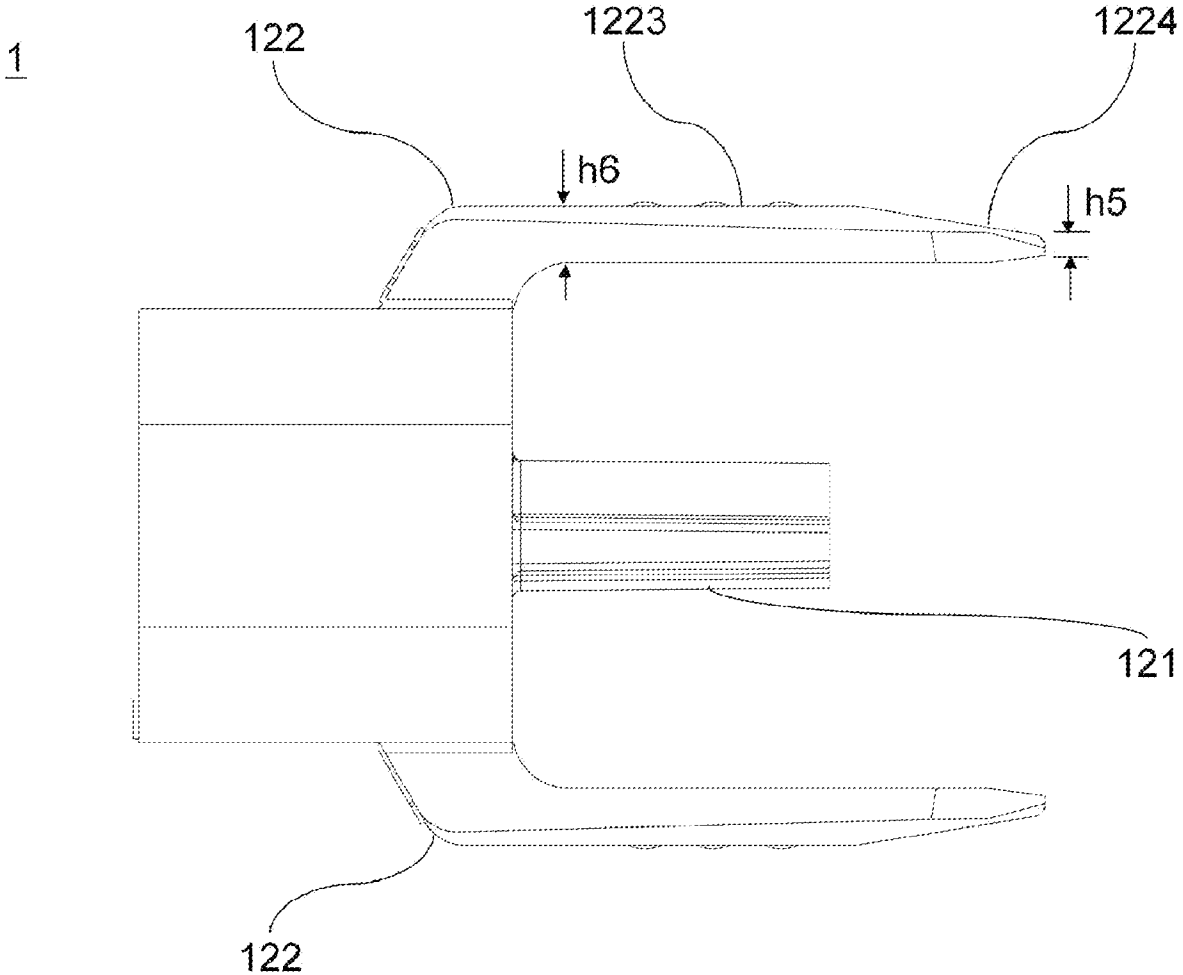
FIG. 5C is a lateral sectional view the fourth insulating casing according to the second preferred embodiment of the present invention.

Please additionally refer to FIG. 5A. According to a second embodiment of the present invention, each said second coupling structure 222 of the female connector 2 includes a pair of facing walls 2220. Each said wall 2220 has a second flange 2223 extending toward the other said wall 2220. In each said second coupling structure 222, the second flanges 2223 and the fourth insulating casing 22 jointly define an eighth opening 204. Please see FIGS. 5B and 5C. Each said first coupling structure 122 of the male connector 1 is a flat arm 1223. Third wedges 224 are provided in the eighth opening 204 defined by the second flange 2223 and the fourth insulating casing 22 so as to give the eighth opening 204 a tapered shape with a minimum height h4. In addition, each said flat arm 1223 of the first coupling structure 122 has a front end formed with a fourth wedge 1224 so that the flat arm 1223 has a thickness h6 gradually reduced from its rear end to its front end and has a front end thickness h5. Therein, the minimum height h4 of the eighth opening 204 is smaller than the front-end thickness h5 of the flat arm 1223. Therefore, upon combination of the male connector 1 and the female connector 2, the first coupling structures 122 of the male connector 1 are coupled with the second coupling structures 222 of the female connector 2. By the joint guidance of the third wedges 2224 and the fourth wedges 1224, the eighth opening 204 performs elastic deformation, so as to allow the flat arms 1223 to be inserted therein. After the insertion of the flat arms 1223, since the minimum height h4 of the eighth openings 204 is smaller than the front end thickness h5 of the flat arms 1223, the flat arms 1223 are retained from leaving the eighth openings 204, thereby ensuring the firmer combination between the male connector 1 and the female connector 2.

In the above embodiment, the hollow plug 121 of the second insulating casing 12 of the male connector 1 has a downward narrowing shape while the hollow socket 221 of the fourth insulating casing 22 of the female connector 2 is of a matching downward narrowing shape, so as to prevent one of the hollow plug 121 of the male connector 1 and the hollow socket 221 of the female connector 2 from assembling to the other in an upside-down manner, in turn preventing miswiring.

The embodiments described above are intended only to demonstrate the technical concept and features of the present invention so as to enable a person skilled in the art to understand and implement the contents disclosed herein. It is understood that the disclosed embodiments are not to limit the scope of the present invention. Therefore, all equivalent changes or modifications based on the concept of the present invention should be encompassed by the appended claims.

What is claimed is:

1. A securely latched power connector assembly, comprising a male connector and a female connector, the male connector and the female connector connected with at lease one first leading wire and at lease one second leading wire, respectively, each of the first leading wire and the second leading wire having a core and an insulating jacket, the securely latched power connector assembly being characterized in:

the male connector including a first insulating casing, a second insulating casing, and at least one first conductive terminal; the first insulating casing having at least one first opening formed at a rear end thereof for allowing the core of the at least one said first leading wire to be inserted thereinto; the first insulating casing having at least one second opening formed at a front end thereof and intercommunicating with the first opening; each said first conductive terminal accommodated in the second opening; the first conductive terminal having a first bottom plate that is bent upward near the first opening to form a first inclined portion; the first inclined portion having a first through hole for allowing the core of the first leading wire to pierce therethrough; the first inclined portion bent downward at an upper end thereof to form a first buckle portion for retaining the core of the first leading wire; the first bottom plate having an end distant from the first through hole extending outward to form a first pin; the second insulating casing having a third opening formed at a rear end thereof for allowing the front end of the first insulating casing to be inserted thereinto; the second insulating casing having a front end extending outward to form at least one hollow plug for accommodating the first pin of the first conductive terminal therein; the second insulating casing having an upper and a lower surfaces each formed with a first coupling structure; the male connector further including at least one first resilient plate, each said first resilient plate located between the second insulating casing and the inclined portion of the first conductive terminal; and the female connector including a third insulating casing, a fourth insulating casing, and at least one second conductive terminal; the third insulating casing having at least one fourth opening formed at a front end thereof for allowing the core of the at least one said second leading wire to be inserted thereinto; the third insulating casing having at least one fifth opening formed at a rear end thereof and intercommunicating with the fourth opening; each said second conductive terminal accommodated in the fifth opening; the second conductive terminal having a second bottom plate that is bent upward near the fourth opening to form a second inclined portion; the second inclined portion having a second through hole for allowing the core of the second leading wire to pierce therethrough; the second inclined portion bent downward at an upper end thereof to form a second buckle portion for retaining the core of the second leading wire; the second bottom plate having an end distant from the second through hole extending outward to form a second pin; the fourth insulating casing having a sixth opening formed at a front end thereof for allowing the rear end of the third insulating casing to be inserted thereinto; the fourth insulating casing having a rear end extending outward to form at least one hollow socket for accommodating the second pin of the second conductive terminal therein; the fourth insulating casing having an upper and a lower surfaces each formed with a second coupling structure for fittingly coupled with a corresponding said first coupling structure of the male connector; the female connector further including at least one second resilient plate, each said second resilient plate located between the fourth insulating casing and the inclined portion of the second conductive terminal;

thereby, when the male connector and the female connector are combined, the hollow plug of the male connector being accommodated in the hollow socket of the female connector, the first coupling structures of the male connector and the second coupling structures of the female connector being firmly coupled with each other, and the second pin of the second conductive terminal being inserted into the hollow plug and so as to contact with the first pin of the first conductive terminal, thereby achieving electrical connection.

2. The securely latched power connector assembly of claim 1, wherein the hollow plug of the second insulating casing of the male connector has an outer periphery in a downward narrowing shape while the hollow socket of the fourth insulating casing of the female connector has an inner periphery in a downward narrowing shape.

3. The securely latched power connector assembly of claim 1, wherein the first pin of the first conductive terminal is bent to form a first claw for better contacting with the second pin of the second conductive terminal.

4. The securely latched power connector assembly of claim 1, wherein the first bottom plate of the first conductive terminal further has a first groove for accommodating the core of the first leading wire therein.

5. The securely latched power connector assembly of claim 1, wherein the first buckle portion of the first conductive terminal further includes a first notch for facilitating holding the core of the first leading wire with improved firmness.

6. The securely latched power connector assembly of claim 1, wherein the first pin of the first conductive terminal has a width smaller than a width of the first bottom plate of the first conductive terminal.

7. The securely latched power connector assembly of claim 1, wherein the second pin of the second conductive terminal is bent to form a second claw for better contacting with the first pin of the first conductive terminal.

8. The securely latched power connector assembly of claim 1, wherein the second bottom plate of the second conductive terminal further has a second groove for accommodating the core of the second leading wire therein.

9. The securely latched power connector assembly of claim 1, wherein the second buckle portion of the second conductive terminal further includes a second notch for facilitating holding the core of the second leading wire with improved firmness.

10. The securely latched power connector assembly of claim 1, wherein the second pin of the second conductive terminal has a width smaller than a width of the second bottom plate of the second conductive terminal.

11. The securely latched power connector assembly of claim 1, wherein each said first coupling structure of the male connector includes a pair of facing walls, each said wall having a first flange extending toward the other said wall, thereby defining a seventh opening, and each said second coupling structure of the female connector is a flat arm for being fittingly inserted into the corresponding seventh opening.

12. The securely latched power connector assembly of claim 11, wherein a first wedge is provided between each said first flange and the second insulating casing so as to give the seventh opening a tapered shape, the seventh opening having a minimum opening height smaller than a thickness of the flat arm.

13. The securely latched power connector assembly of claim 11, wherein each said flat arm has a front end formed with a second wedge so that the flat arm has a thickness gradually reduced from a rear end to a front end thereof.

14. The securely latched power connector assembly of claim 1, wherein each said second coupling structure of the female connector includes a pair of facing walls, each said wall having a first flange extending toward the other said wall, thereby defining a seventh opening, and each said first coupling structure of the male connector is a flat arm for being fittingly inserted into the corresponding seventh opening.

15. The securely latched power connector assembly of claim 14, wherein a first wedge is provided between each said first flange and the second insulating casing so as to give the seventh opening a tapered shape, the seventh opening having a minimum opening height smaller than a thickness of the flat arm.

16. The securely latched power connector assembly of claim 14, wherein each said flat arm has a front end formed with a second wedge so that the flat arm has a thickness gradually reduced from a rear end to a front end thereof.

* * * * *